US007425939B2

(12) United States Patent
Asano

(10) Patent No.: US 7,425,939 B2
(45) **Date of Patent: *Sep. 16, 2008**

(54) ACTIVE MATRIX TYPE DISPLAY APPARATUS, ACTIVE MATRIX TYPE ORGANIC ELECTROLUMINESCENCE DISPLAY APPARATUS, AND DRIVING METHODS THEREOF

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 501 days.

This patent is subject to a terminal disclaimer.

(21) Appl. No.: 11/145,161

(22) Filed: Jun. 3, 2005

(65) Prior Publication Data

US 2005/0218821 A1 Oct. 6, 2005

Related U.S. Application Data

(63) Continuation of application No. 10/158,693, filed on May 30, 2002, now Pat. No. 6,975,290.

(30) Foreign Application Priority Data

May 31, 2001 (JP) ..... P2001-163955
May 10, 2002 (JP) ..... P2002-134918

(51) Int. Cl.
*G09G 3/30* (2006.01)

(52) U.S. Cl. ..... 345/76; 345/36

(58) Field of Classification Search ..... 345/76, 345/92–100, 204–206, 36, 77, 87, 90; 315/169.3
See application file for complete search history.

(56) References Cited

U.S. PATENT DOCUMENTS 6,535,185 B2 * 3/2003 Kim et al. ..... 345/76
6,753,656 B2 * 6/2004 Kimura ..... 315/169.3
6,765,549 B1 * 7/2004 Yamazaki et al. ..... 345/80

* cited by examiner

*Primary Examiner*—Ricardo L Osorio
(74) *Attorney, Agent, or Firm*—Sonnenschein Nath & Rosenthal LLP

(57) ABSTRACT

An active matrix type organic EL display apparatus according to the present invention which apparatus uses current writing type pixel circuits is provided with a current control circuit for each of data lines connected to the pixel circuits. The current control circuit supplies part of a data line current to a pixel circuit as a bypass current. The current control circuit handles the bypass current of the data line current represented by (data line current=data current+bypass current). Thereby, the data line driving current can be set greater than the data current flowing through TFTs provided in the pixel circuit, thus reducing luminance data writing time. Also, when the writing time is set unchanged, transistor size of the TFTs provided in the pixel circuit can be reduced.

14 Claims, 16 Drawing Sheets

ACTIVE MATRIX TYPE DISPLAY APPARATUS, ACTIVE MATRIX TYPE ORGANIC ELECTROLUMINESCENCE DISPLAY APPARATUS, AND DRIVING METHODS THEREOF

CROSS REFERENCE TO RELATED APPLICATIONS

This is a continuation of U.S. application Ser. No. 10/158,693, filed on May 30, 2002, now U.S. Pat. No. 6,975,290 which is incorporated herein by reference to the extent permitted by law. The present application claims priority to Japanese Applications Nos. P2001-163955 filed May 31, 2001, and P2002-134918 filed May 10, 2002, which applications are incorporated herein by reference to the extent permitted by law.

FIELD OF THE INVENTION

The present invention relates to an active matrix type display apparatus having an active device in each pixel and controlling display in the pixel unit by means of the active device, and a driving method thereof, and particularly to an active matrix type organic EL display apparatus using an organic-material electroluminescence (hereinafter described as organic EL (electroluminescence)) device as an electrooptic device, and a driving method thereof.

A liquid crystal display using a liquid crystal cell as a display device of a pixel, for example, has a large number of pixels arranged in a matrix manner, and controls light intensity in each pixel according to information of an image to be displayed, thereby effecting driving for image display. The same display driving is effected by an organic EL display using a current-controlled type electrooptic device, for example an organic EL device as a display device of a pixel.

The organic EL device has a structure formed by sandwiching an organic layer made of organic material including a light emitting layer between two electrodes. When a voltage is applied to the device, an electron is injected from the cathode into the organic layer and a hole is injected from the anode into the organic layer, and then the electron and the hole are recombined with each other to emit light. The organic EL device provides a brightness of a few 100 to a few 10000 cd/m$^2$ at a driving voltage of 10 V or lower, and is a self-luminous device. The organic EL device has advantages such as high image contrast and high response speed. Thus, an organic EL display using the organic EL device as a display device of a pixel is considered promising as a next-generation flat-panel display.

As driving methods of the organic EL display, there are a passive matrix method and an active matrix method. The passive matrix method emits light only at a moment when a light emitting device of each pixel is selected. While the passive matrix method has a simple construction, the passive matrix method has problems such as difficulty in realizing a large high-definition display. On the other hand, the active matrix method can maintain light emission of the organic EL device in each pixel for a period of one frame, and therefore may be said to be a driving method suitable for increasing size, resolution, and brightness of the display.

In an active matrix type organic EL display, a polysilicon thin film transistor (TFT) is generally used as an active device in a pixel circuit for controlling brightness of each pixel. Controlling variations in characteristics of the thin film transistor and compensating for variations in the characteristics of the thin film transistor by circuit means are major problems of the active matrix type organic EL display using the thin film transistor in the pixel circuit. This is for reasons mentioned in the following.

A liquid crystal display using a liquid crystal cell as a display device of a pixel controls luminance data of each pixel by a voltage value. On the other hand, an organic EL display controls luminance data of each pixel by a current value. A configuration of a simplest active matrix type organic EL display using voltage writing type pixel circuits is schematically shown in FIG. 1. A circuit configuration of a voltage writing type pixel circuit is shown in FIG. 2.

As shown in FIG. 1, an active matrix type organic EL display has a large number of pixel circuits 101 arranged in a matrix manner, and repeats writing luminance data by supplying the luminance data in a form of voltage from a voltage driving type data line driving circuit 104 through data lines 105-1 to **105-*m* while selecting scanning lines 102-1 to 102-*n* sequentially by a scanning line driving circuit 103**. A pixel arrangement of m columns and n rows is shown in this case. Of course, in this case, the number of data lines is m and the number of scanning lines is n.

As is clear from FIG. 2, the voltage writing type pixel circuit 101 includes: an organic EL device 111 having a cathode connected to a first power supply (for example negative power supply); a P-channel TFT 112 having a drain connected to an anode of the organic EL device 111 and a source connected to a second power supply (for example ground); a capacitor 113 connected between a gate of the TFT 112 and the second power supply; and an N-channel TFT 114 having a drain connected to the gate of the TFT 112, a source connected to the data line 105 (105-1 to **105-*m*), and a gate connected to the scanning line 102 (102-1 to 102-*n***).

In the thus formed pixel circuit 101, the TFT 114 selects the pixel for writing the luminance data, and controls the capacitor 113 to retain the luminance data voltage. The capacitor 113 retains the luminance data voltage supplied through the TFT 114. The TFT 112 drives the organic EL device 111 according to the luminance data voltage retained by the capacitor 113.

In this case, letting Le1 be luminous brightness of the organic EL device 111, Ie1 be a current flowing through the organic EL device 111, Vth be a threshold voltage of the TFT 112, k be a constant of proportionality, and Vdata be the data voltage retained by the capacitor 113, when the TFT 112 is used in a saturation region, the following equation holds:

$$Le1 \propto Ie1 = k(Vdata - Vth)^2 \quad (1)$$

where $k = \frac{1}{2} \cdot \mu \cdot Cox \cdot W/L$, wherein μ is mobility of the TFT 112; Cox is gate capacitance per unit area; W is gate width; and L is gate length.

As is clear from the equation (1), the value of the current supplied to the organic EL device 111, that is, the luminous brightness of the organic EL device 111 is affected by variations in the mobility μ (∝k) of the TFT 112 and the threshold voltage Vth. In fact, it is known that amorphous silicon and polysilicon used to form the TFT have inferior crystallinity and inferior controllability of the conducting mechanism to single-crystal silicon, and thus the TFT has great variations in transistor characteristics. It is therefore difficult to fabricate a high-quality organic EL display having a number of gradation levels that makes it possible to display a natural picture by using the voltage writing type pixel circuits.

As a method for solving the problem, the present applicant has proposed a current writing type pixel circuit to which luminance data is written in a form of current (see International Publication Number 01/06484). An example of configuration of the current writing type pixel circuit is shown in FIG. 3.

As is clear from FIG. 3, the current writing type pixel circuit includes: an organic EL device 121 having a cathode connected to a first power supply (for example negative power supply); a P-channel TFT 122 having a drain connected to an anode of the organic EL device 121 and a source connected to a second power supply (for example ground); a capacitor 123 connected between a gate of the TFT 122 and the second power supply; an N-channel TFT 124 having a drain connected to a data line 128, and a gate connected to a first scanning line 127A; a P-channel TFT 125 having a drain and a gate connected to a source of the TFT 124, and a source connected to the second power supply; and an N-channel TFT 126 having a drain connected to the drain and gate of the TFT 125, a source connected to the gate of the TFT 122, and a gate connected to a second scanning line 127B.

The TFTs 124 and 126 in the thus formed current writing type pixel circuit each function as an analog switch. The TFT 125 converts a luminance data current to be written into a voltage. The capacitor 123 retains a luminance data voltage obtained by the TFT 125 by converting the luminance data current into the voltage. The TFT 122 converts the luminance data voltage retained by the capacitor 123 into a current and feeds the current obtained by the conversion to the organic EL device 121. The TFT 125 and the TFT 122 form a current mirror circuit.

An active matrix type organic EL display shown in FIG. 4 is formed by arranging such current writing type pixel circuits in a matrix manner. In FIG. 4, first scanning lines 127A-1 to 127A-n and second scanning lines 127B-1 to 127B-n are both arranged one for each of rows of current writing type pixel circuits 131 corresponding in number with m columns×n rows and arranged in a matrix manner. In each pixel, the gate of the TFT 124 in FIG. 3 is connected to the first scanning line 127A-1 to 127A-n and the gate of the TFT 126 in FIG. 3 is connected to the second scanning line 127B-1 to 127B-n.

A first scanning line driving circuit 132A is provided on a left side of the pixel unit to drive the first scanning lines 127A-1 to 127A-n, while a second scanning line driving circuit 132B is provided on a right side of the pixel unit to drive the second scanning lines 127B-1 to 127B-n. Data lines 133-1 to 133-*m* are arranged one for each of the columns of the pixel circuits 131. One end of each of the data lines 133-1 to 133-*m* is connected to an output terminal for each column of a current driving type data line driving circuit 134. The data line driving circuit 134 writes the luminance data current to each of the pixels through the data lines 133-1 to 133-*m*.

A circuit configuration of a plurality of pixel circuits 131-k−1 to 131-k+2 connected to an ith-column data line 128-*i* in the thus formed active matrix type organic EL display is shown in FIG. 5. A driving timing relation between the pixel circuits is shown in FIG. 6.

When a luminance data current is written to a selected pixel circuit through the data line 128-*i*, a first scanning line (represented by WS (Write Scan) in the figures) and a second scanning line (represented by ES (Erase Scan) in the figures) are selected to turn on the TFT 124 and the TFT 126 (see FIG. 3). In this case, the TFT 125 converts the luminance data current into a voltage. The capacitor 123 retains the voltage obtained by the conversion. The TFT 122 converts the luminance data voltage retained by the capacitor 123 into a luminance data current and feeds the luminance data current to the organic EL device 121 to thereby drive the organic EL device 121.

Letting W1 be gate width of the TFT 125, L1 be gate length of the TFT 125, W2 be gate width of the TFT 122, and L2 be gate length of the TFT 122, a writing data current Iw, luminous brightness Le1 of the organic EL device 121 of each of the pixel circuits 131-k−1 to 131-k+2, and a current Ie1 flowing through the organic EL device 121 satisfy the following relation:

$$Le1 \propto Ie1 = (W2/L2)/(W1/L1)\cdot Iw \quad (2)$$

As is clear from the equation (2), the written data current Iw is in proportion to the current Ie1 flowing through the organic EL device 121. When there are no variations in transistor characteristics of the TFTs 125 and 122 disposed in a local area within the pixel and forming the current mirror circuit, variations in the luminous brightness of the display are compensated for. Thus, by using the current writing type pixel circuits, it is possible to realize an organic EL display having a large number of display gradation levels, that is, a number of gradation levels that makes it possible to display a natural picture.

However, when low luminance data is written to a pixel circuit in the active matrix type organic EL display using the current writing type pixel circuits as described above, impedance of the data line is increased, and therefore a writing time required to write the data current becomes longer. In practice, when size of one pixel is a few 100 μm□ or less, a current flowing through an organic EL device of one pixel is at most a few 10 μA or less. For display of many gradation levels, for example 256 gradation levels, it is necessary to control a current of a few to a few 10 A or less.

In order to shorten the data current writing time, it suffices to set a mirror ratio of the current mirror circuit to be (W2/L2)<(W1/L1) and increase the writing data current. However, increasing the writing current means that a great current needs to be passed through the TFTs 124 and 125. Then, size of the TFTs 124 and 125 needs to be increased, which results in an increase in size of the pixel circuit. Thus, in an organic EL display using current writing type pixel circuits, shortening the data writing time and decreasing the size of the pixel circuits are in a trade-off relation with each other.

Letting the number of scanning lines be Nscan and frame frequency be f, the data writing time Twrite is expressed by the following equation:

$$Twrite=1/(f\cdot Nscan) \quad (3)$$

As is clear from the equation (3), in order to increase the size and resolution of the organic EL display, it is necessary to shorten the data writing time Twrite and at the same time decrease the size of the pixel circuits. Thus, both shortening the data writing time and decreasing the size of the pixel circuits in a trade-off relation need to be satisfied at the same time.

OBJECTS AND SUMMARY OF THE INVENTION

It is an object of the present invention to provide an active matrix type display apparatus, an active matrix type organic EL display apparatus, and driving methods thereof that make it possible to increase the display size and resolution by reducing the data writing time while preventing an increase in size of transistors in a pixel circuit when a current writing type pixel circuit is used.

In order to achieve the above object, according to the present invention, there is provided an active matrix type display apparatus comprising: a pixel unit formed by arranging pixel circuits in a matrix manner, the pixel circuits each having an electrooptic device; data line driving means for supplying luminance data to the pixel circuits as a data line current via data lines; and current control means (hereinafter described as a "data line control circuit" in embodiments) for driving the data line current supplied from the data line driving means as a data current for writing the luminance data to each of the pixel circuits and a remaining bypass current.

The current control means, which is a characteristic part of the present invention, handles the bypass current of the data line current. It is thereby possible to substantially reduce time for writing the data current flowing through TFTs provided in the pixel circuit. In addition, when the writing time is set unchanged, transistor size of the TFTs provided in the pixel circuit can be reduced. An organic EL device having a first electrode, a second electrode, and an organic layer including a light emitting layer between the first electrode and the second electrode, for example, is used as the electrooptic device in the present invention.

DETAILED DESCRIPTION OF PREFERRED EMBODIMENTS

Preferred embodiments of the present invention will hereinafter be described in detail with reference to the drawings.

First Embodiment

Figure 7:
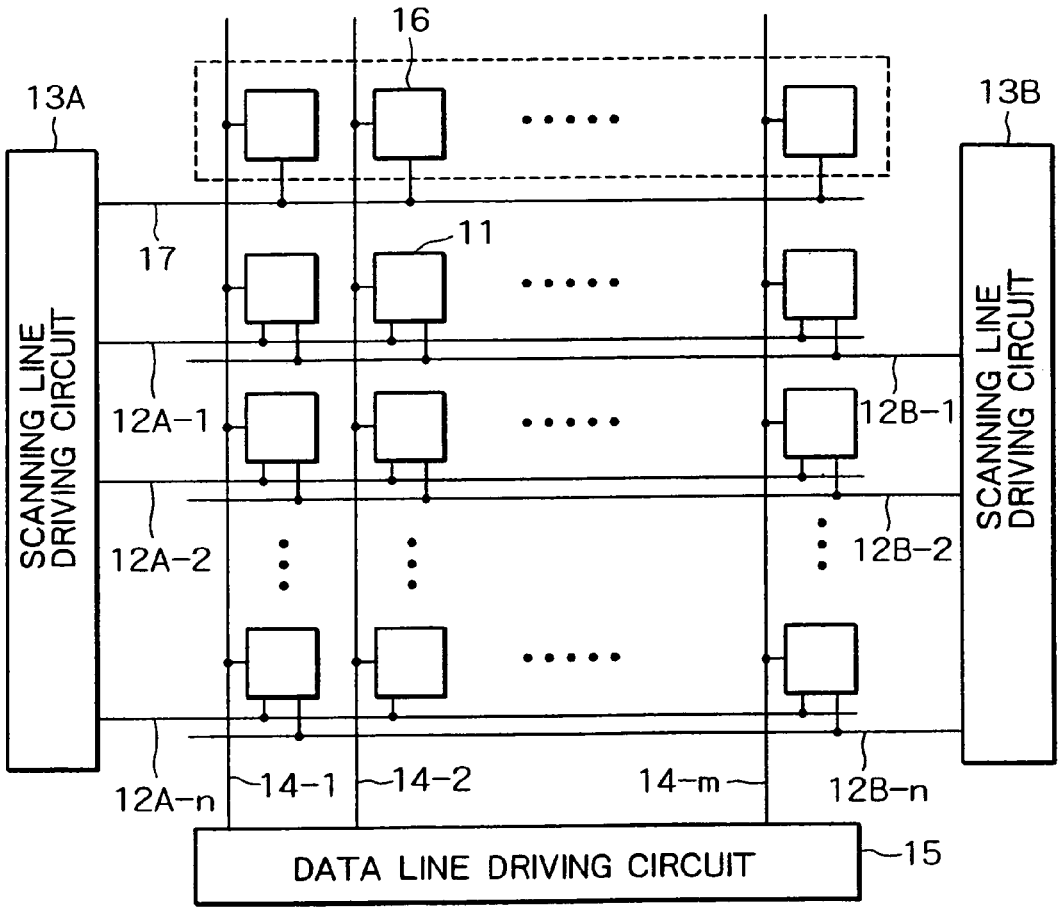
FIG. 7 is a schematic diagram of a configuration of an active matrix type display apparatus according to a first embodiment of the present invention.

FIG. 7 is a schematic diagram of a configuration of an active matrix type display apparatus according to a first embodiment of the present invention. Description in the following will be made by taking as an example an active matrix type organic EL display apparatus formed by using an organic EL device as a current-controlled type electrooptic device and a polysilicon thin film transistor as an active device, and forming the organic EL device on a substrate where the polysilicon thin film transistor is formed. The same is true for embodiments to be described later.

In FIG. 7, current writing type pixel circuits 11 corresponding in number with m columns×n rows are arranged in a matrix manner. First scanning lines 12A-1 to 12A-n and second scanning lines 12B-1 to 12B-n are both arranged one for each of the rows of the pixel circuits 11. A first scanning line driving circuit 13A is provided on a left side of the pixel unit to drive the first scanning lines 12A-1 to 12A-n, while a second scanning line driving circuit 13B is provided on a right side of the pixel unit to drive the second scanning lines 12B-1 to 12B-n.

Data lines 14-1 to 14-*m* are arranged one for each of the columns of the pixel circuits 11. One end of each of the data lines 14-1 to 14-*m* is connected to an output terminal for each column of a data line driving circuit 15. The data line driving circuit 15 writes a luminance data current to each of the pixel circuits 11 through the data lines 14-1 to 14-*m*. Data current control circuits 16 are provided for example one for each of the columns of the pixel unit at for example an upper end portion of the pixel unit. A current control scanning line 17 is disposed commonly to the data current control circuits 16. The current control scanning line 17 is driven by the first scanning line driving circuit 13A.

Figure 8A:
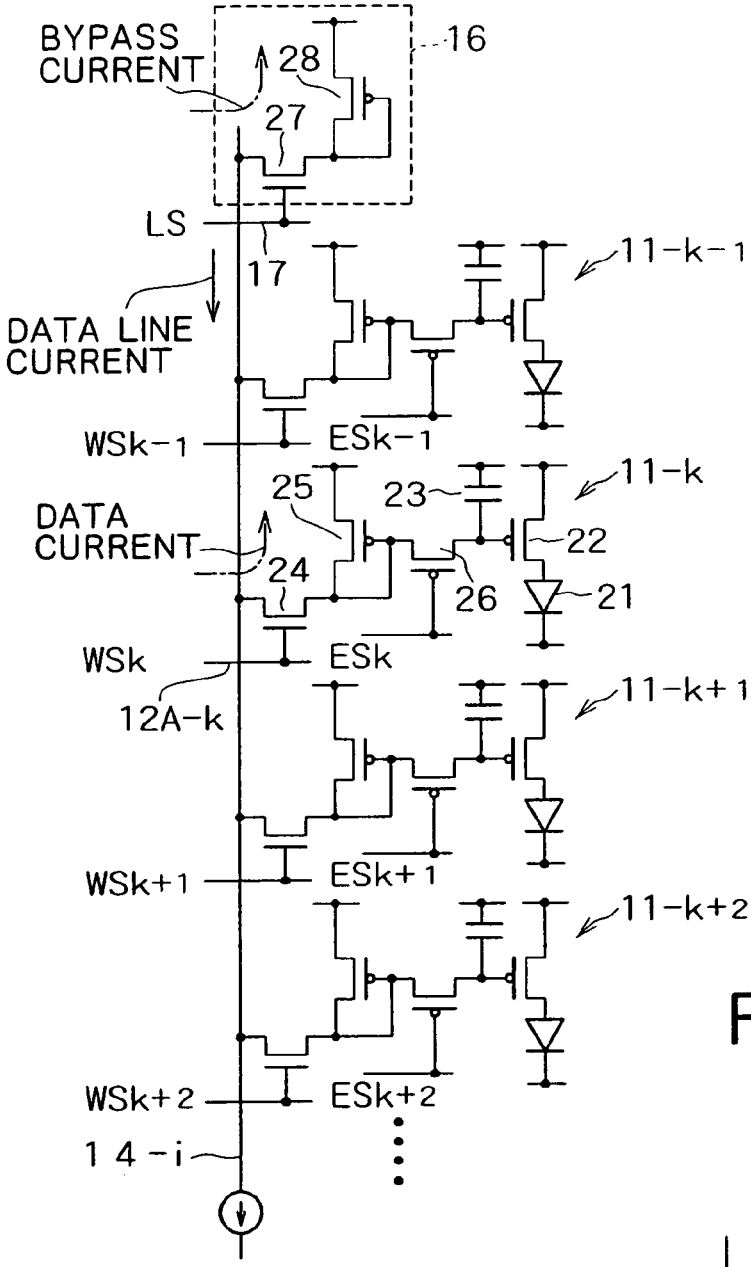
FIG. 8A shows a circuit configuration of a plurality of pixel circuits connected to an ith-column data line in the first embodiment.
Figure 8B:
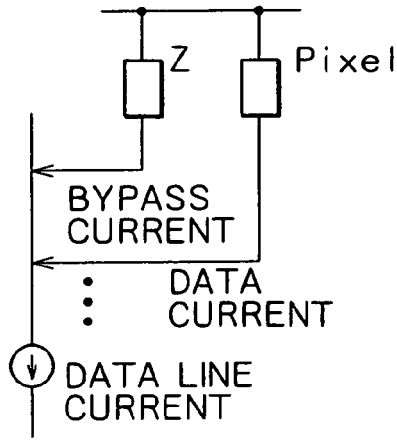
FIG. 8B is a conceptual diagram of circuit operation of the present invention.

A circuit configuration of a plurality of pixel circuits 11-k−1 to 11-k+2 connected to an ith-column data line 14-*i* in the thus formed active matrix type organic EL display apparatus will be shown in FIGS. 8A and 8B.

The pixel circuit 11-*k* includes: an organic EL device 21 having a cathode connected to a first power supply (for example negative power supply); a P-channel TFT 22 having a drain connected to an anode of the organic EL device 21 and a source connected to a second power supply (for example ground); a capacitor 23 connected between a gate of the TFT 22 and the second power supply; an N-channel TFT 24 having a drain connected to the data line 14-*i*, and a gate connected to a first scanning line 12A-k; a P-channel TFT 25 having a drain and a gate connected to a source of the TFT 24, and a source connected to the second power supply; and a P-channel TFT 26 having a drain connected to the drain and gate of the TFT 25, a source connected to the gate of the TFT 22, and a gate connected to a second scanning line 12B-k.

The TFTs 24 and 26 in the thus formed current writing type pixel circuit 11-*k* each function as an analog switch. The TFT 25 converts the luminance data current to be written into a voltage. The capacitor 23 retains a luminance data voltage obtained by the TFT 25 by converting the luminance data current into the voltage. The TFT 22 converts the luminance data voltage retained by the capacitor 23 into a current and thereby drives the organic EL device 21. The TFT 25 and the TFT 22 have substantially the same characteristics, thus forming a current mirror circuit.

In this case, let W11 be gate width of the TFT 24, L11 be gate length of the TFT 24, W12 be gate width of the TFT 25, and L12 be gate length of the TFT 25. Also, let Iw1 be a current flowing through the TFTs 24 and 25. Since gate length is generally controlled by a device fabrication process, the following description assumes that gate length L does not change.

As is clear from FIG. 8A, a data current control circuit 16 includes: an N-channel TFT 27 having a drain connected to the data line 14-*i*, and a gate connected to the current control scanning line 17; and a P-channel TFT 28 having a drain and a gate connected to a source of the TFT 27, and a source grounded. A ratio in size between the TFTs 27 and 28 in the data current control circuit 16 is set to be the same as a ratio in size between the TFTs 24 and 25 in the pixel circuit 11-*k*. In this case, let W21 be gate width of the TFT 27, L21 be gate length of the TFT 27, W22 be gate width of the TFT 28, and L22 be gate length of the TFT 28. Also, let Iw2 be a current flowing through the TFTs 27 and 28.

FIG. 8B is a conceptual diagram of circuit operation of the present invention. As shown in FIG. 8B, a relation between a data line current (I data line) flowing through the data line, a bypass current (I bypass) flowing through the data line control circuit 16, and a data current (I data) flowing through the pixel circuit can be expressed by the following equation:

$$I\ \text{data line} = I\ \text{data} + I\ \text{bypass}\ (\text{preferably}\ I\ \text{data} \leqq I\ \text{bypass})$$

The bypass current flowing through the data line control circuit 16 and the data current flowing through the pixel circuit are determined by input impedance of the data line control circuit 16 and the pixel circuit, respectively. (A current determined by the input impedance of the data line control circuit 16 is defined as the bypass current.) Thus, by using the bypass current as part of the data line current, it is possible to set the data line current greater than the data current flowing through the TFTs 24 and 25 in the pixel circuit 11, and thereby reduce luminance data writing time. In addition, when the writing time is set unchanged, transistor size of the TFTs 24 and 25 provided in the pixel circuit can be reduced and set arbitrarily.

Figure 9:
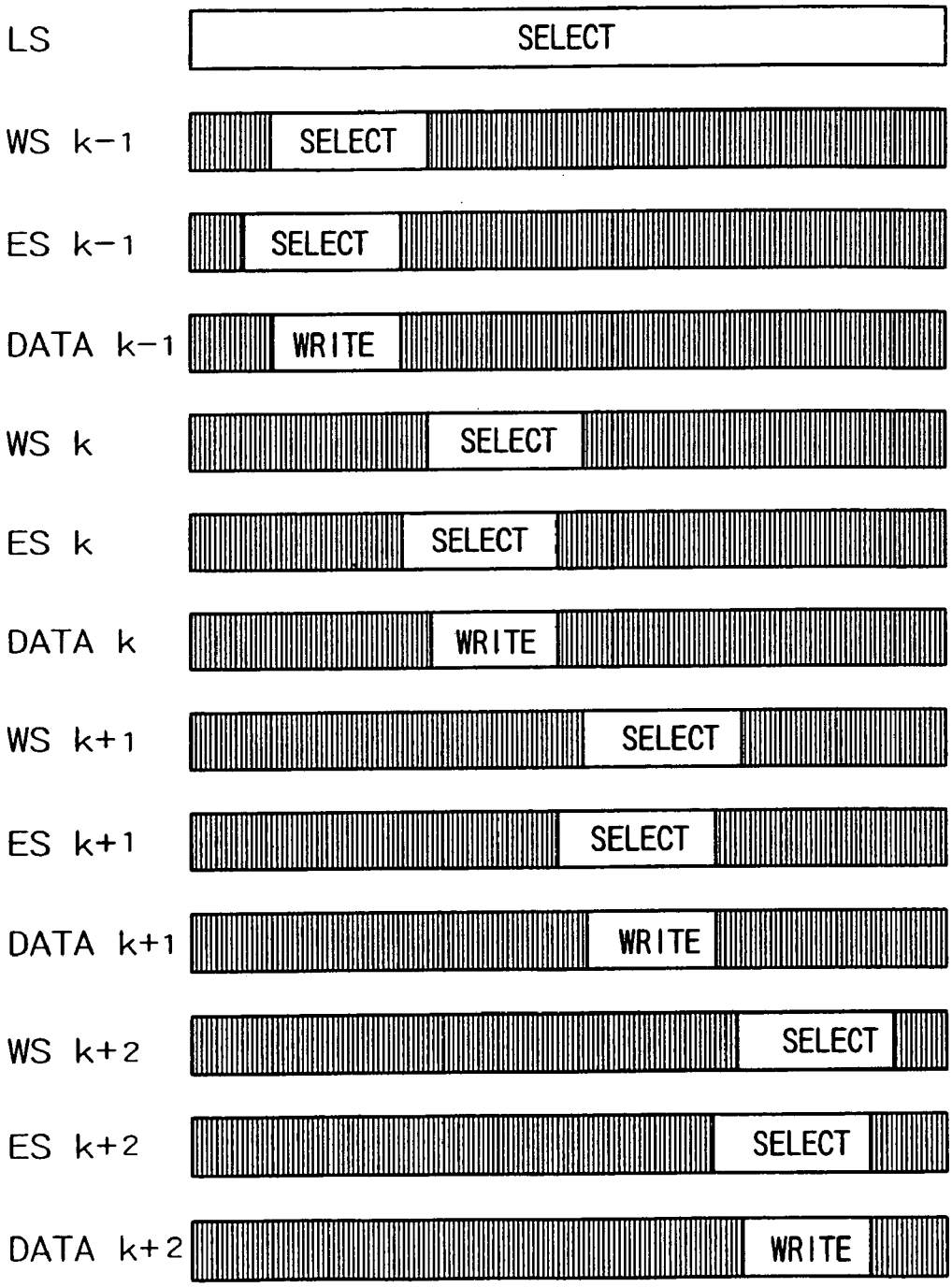
FIG. 9 is a timing chart of a driving timing relation in the ith column in the first embodiment.

FIG. 9 shows a driving timing relation between the ith-column pixel circuits 11-k−1 to 11-k+2. In FIG. 8A and FIG. 9, the first scanning lines 12A-k−1 to 12A-k+2 are represented as WSk−1 to WSk+2; the second scanning lines 12B-k−1 to 12B-k+2 are represented as ESk−1 to ESk+2; and the current control scanning line 17 is represented as LS.

Supposing that luminance data is written to the pixel circuit in the kth row, the first scanning line WSk and the second scanning line ESk are both selected. The current control scanning line LS is selected at all times. Supposing that the data line current for driving the data line 14-*i* is Iw0, and that a ratio R between the data current Iw1 of the data line current Iw0 flowing in the pixel circuit 11-*k* and the remaining current Iw2 of the data line current Iw0 flowing in the data current control circuit 16 is R=Iw1/Iw2, the following relational equation holds:

$$R{:}1{:}(R+1) = Iw1{:}Iw2{:}Iw0$$

Figure 1:
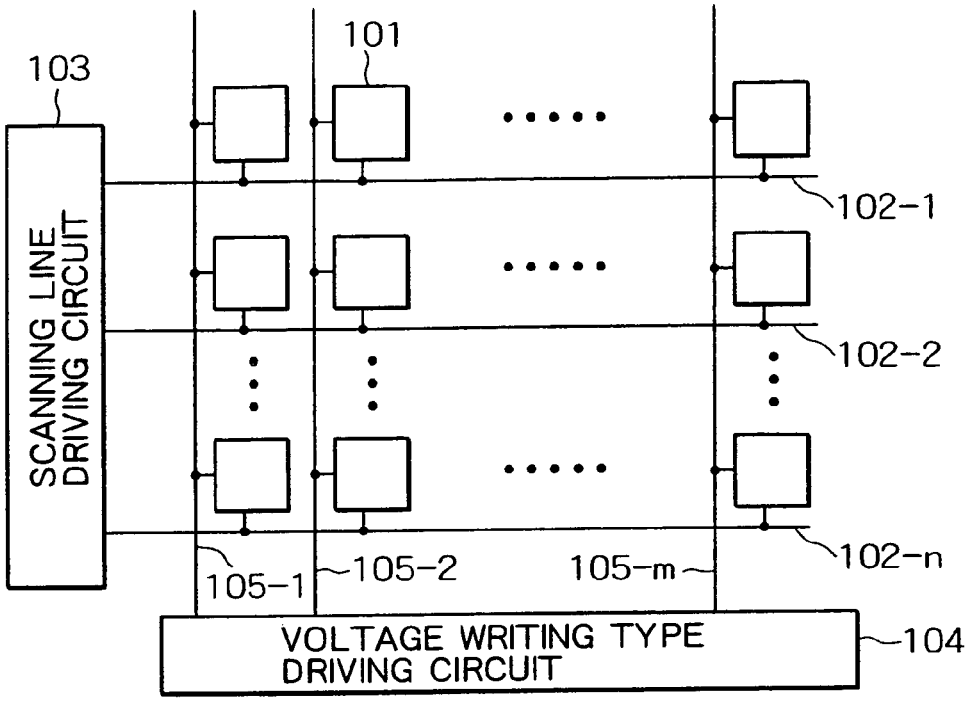
FIG. 1 is a block diagram showing a configuration of an active matrix type organic EL display using voltage writing type pixel circuits.
Figure 2:
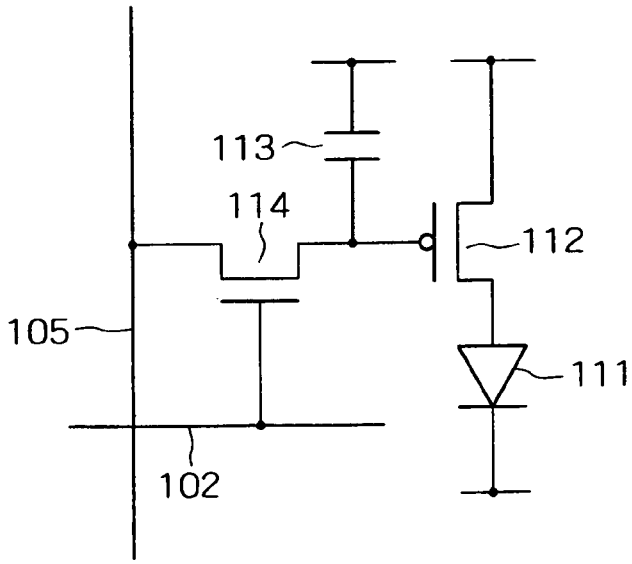
FIG. 2 shows a circuit configuration of a voltage writing type pixel circuit.
Figure 3:
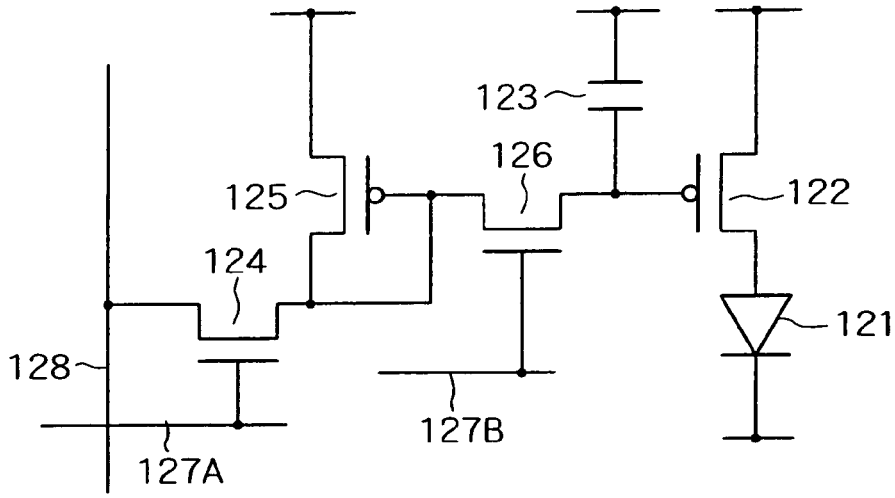
FIG. 3 shows a circuit configuration of a current writing type pixel circuit.

Letting W01 be gate width of the TFT 124 corresponding to the TFT 24, L01 be gate length of the TFT 124, W02 be gate width of the TFT 125 corresponding to the TFT 25, and L02 be gate length of the TFT 125 in the pixel circuit according to the conventional example (see FIG. 3), $$\begin{aligned} R:1:(R+1) &= (W11/L11):(W21/L21):(W01/L01) \\ &= (W12/L12):(W22/L22):(W02/L02) \end{aligned}$$

In this case, setting R=1, for example, and supposing that the gate length L does not change, as described above, then $$W11 = W21 = \tfrac{1}{2} \cdot W01$$

$$L11 = L21 = L01$$

$$W12 = W22 = \tfrac{1}{2} \cdot W02$$

$$L12 = L22 = L02$$

Thus, assuming that the data current Iw1 having the same current value as the current Iw2 is passed through the pixel circuit 11-*k*, the gate widths W11 and W12 of the TFTs 24 and 25 in the pixel circuit 11-*k* can be reduced to ½ (half) of the gate widths W01 and W02 of the TFTs 124 and 125 in the conventional circuit. In other words, when the size of the transistors in the pixel circuit is set to be the same as in the conventional circuit, the data line current Iw0 for driving the data line 14-*i* can be substantially increased.

As described above, in the active matrix type organic EL display apparatus using the current writing type pixel circuits 11, the data current control circuit 16 is provided for each of the data lines 14-1 to 14-*m*, and part of the data line current Iw0 for driving the data lines 14-1 to 14-*m* is supplied to the pixel circuit for writing luminance data and the remaining current of the data line current Iw0 is passed through the data current control circuit 16. It is thereby possible to set the data line current Iw0 greater than the data current Iw1 flowing through the TFTs 24 and 25 in the pixel circuit 11 while preventing an increase in the size of the TFTs 24 and 25. It is thereby possible to reduce the data writing time substantially and thus increase the size and resolution of the organic EL display apparatus.

In order to compensate for variations in the characteristics of the transistors, however, the TFTs 25 and 28 on the writing side forming the current mirror circuit are required to have the same transistor characteristics as the TFT 22 on the driving side. In other words, when the data current control circuit 16 including the TFT 28 is disposed at a position distant from the pixel circuit 11, variations in the transistor characteristics are not fully compensated for.

Accordingly, when the pixel circuits 11 are divided into certain areas in a column direction to thereby combine pluralities of the pixel circuits into blocks, that is, combine pluralities of the pixel circuits connected to the same data line into blocks, and the data current control circuits 16 are provided for example one for each of the blocks in the single data line, it is possible to fully compensate for variations in the transistor characteristics. In this case, a direction along the data lines 14-1 to 14-*m* in the pixel unit formed by arranging the pixel circuits 11 in a matrix manner, that is, a vertical direction is defined as the column direction.

Second Embodiment

Figure 4:
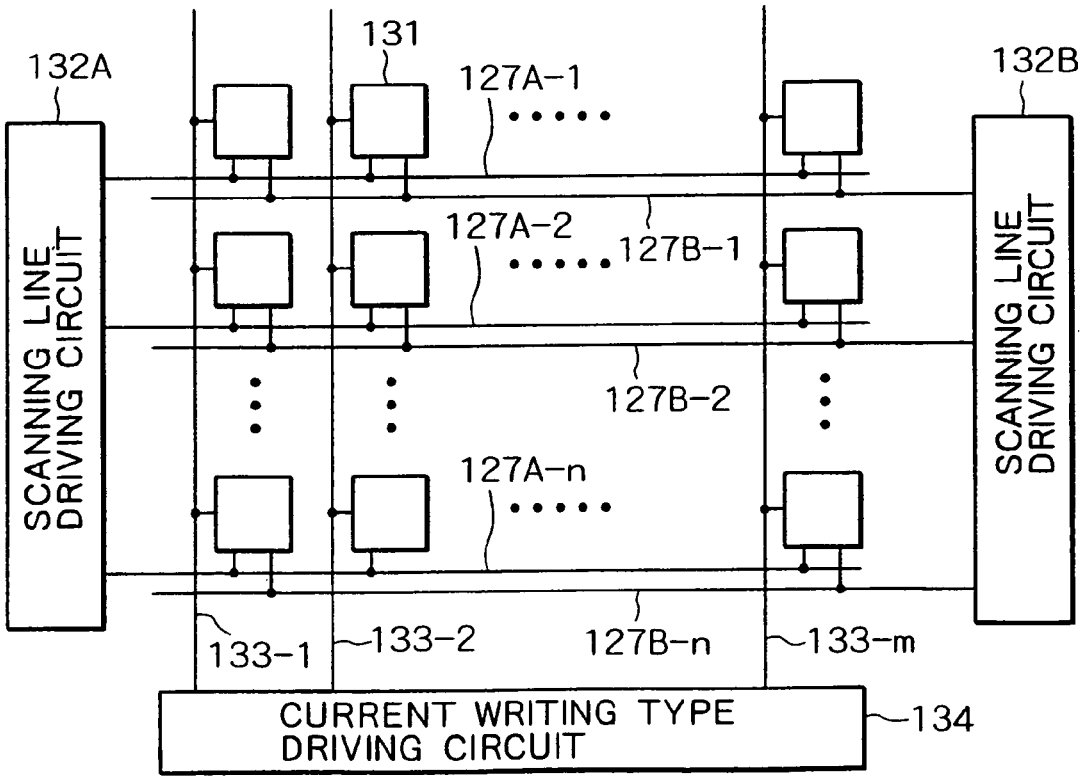
FIG. 4 is a block diagram showing a configuration of an active matrix type organic EL display using current writing type pixel circuits.
Figure 5:
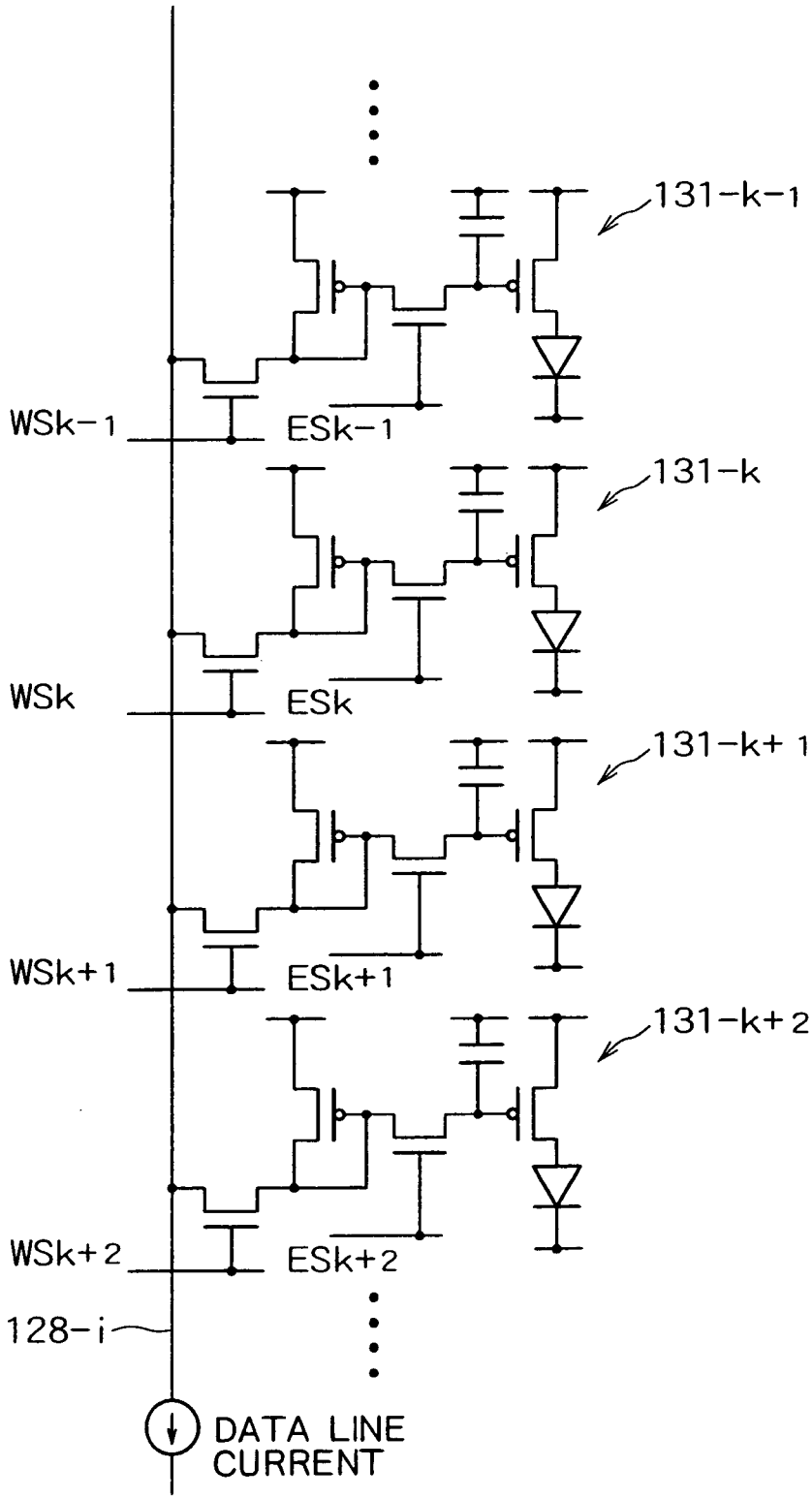
FIG. 5 shows a circuit configuration of a plurality of pixel circuits connected to an ith-column data line in a conventional example.
Figure 6:
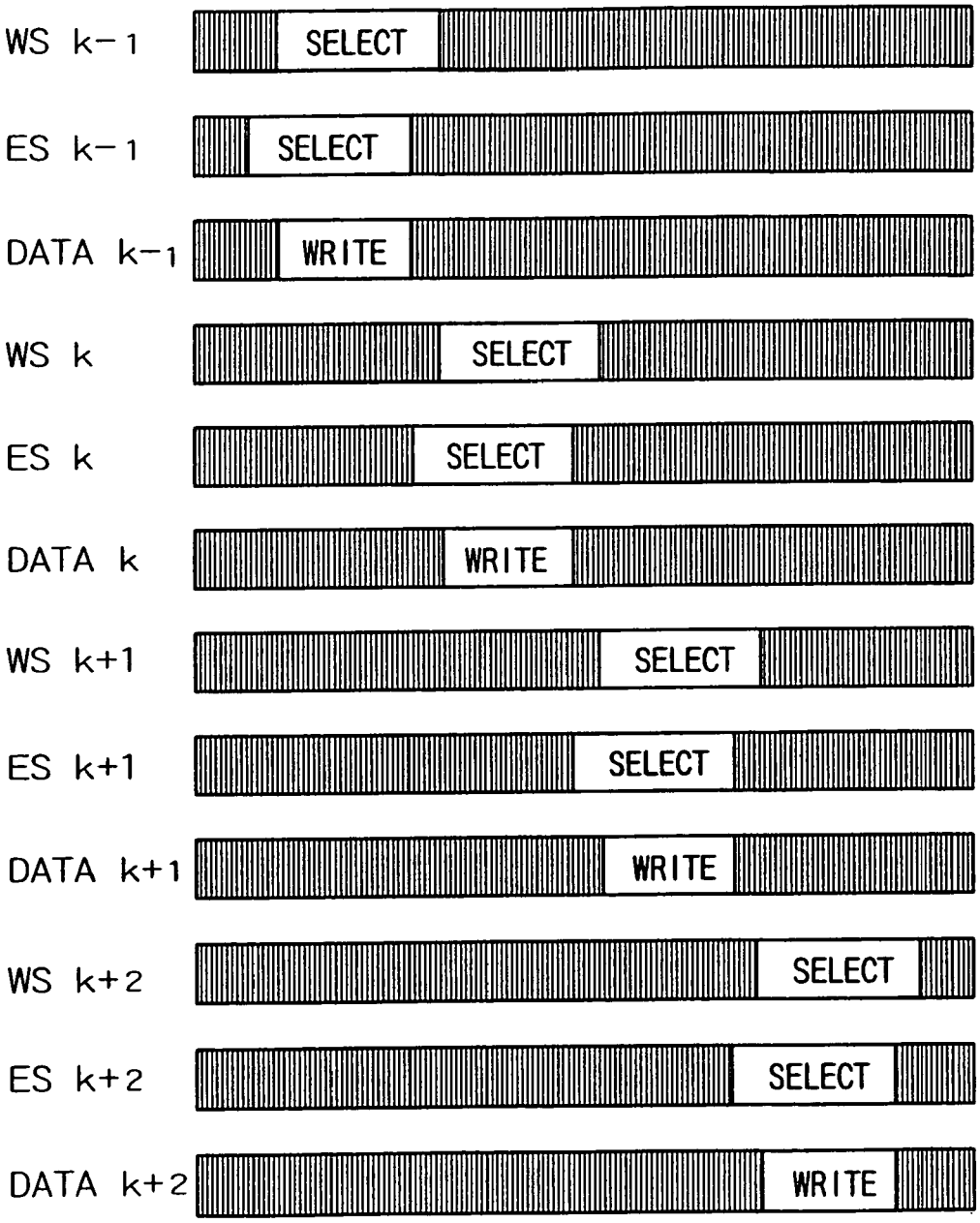
FIG. 6 is a timing chart of a driving timing relation in the ith column in the conventional example.

An active matrix type display apparatus according to a second embodiment of the present invention will next be described. The active matrix type display apparatus according to the second embodiment uses a circuit configuration obtained by omitting the data current control circuits 16 in the active matrix type display apparatus according to the first embodiment as shown in FIG. 7, that is, the same configuration as the active matrix type display apparatus according to the conventional example as shown in FIG. 4.

With this configuration, the active matrix type display apparatus according to the second embodiment realizes the same function as that of the active matrix type display apparatus according to the first embodiment by using a pixel circuit to which no writing is being performed as a data current control circuit (bypass current). A driving method of the active matrix type display apparatus according to the second embodiment will be specifically described in the following.

Figure 10:
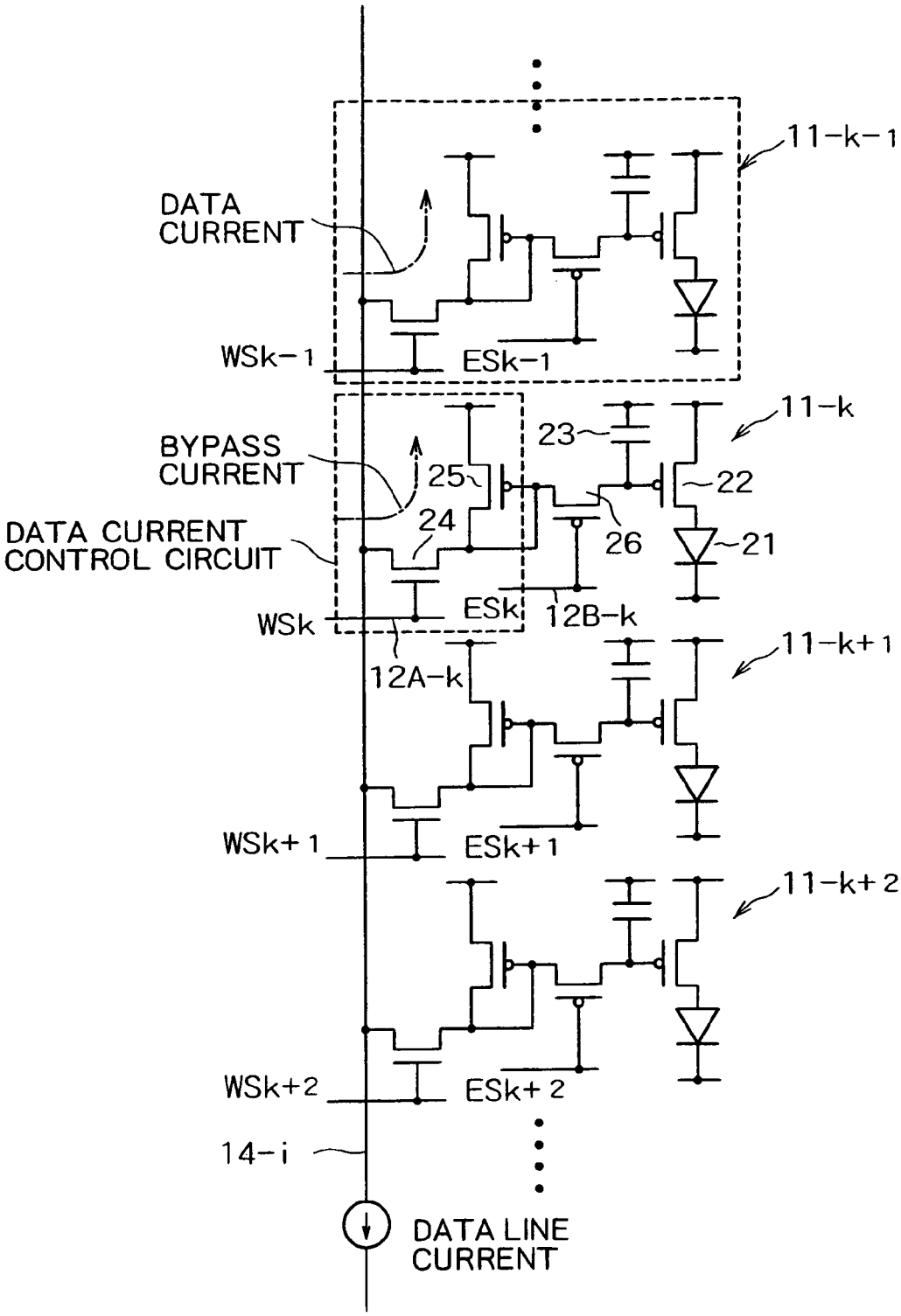
FIG. 10 shows a circuit configuration of a plurality of pixel circuits connected to an ith-column data line in a second embodiment.
Figure 11:
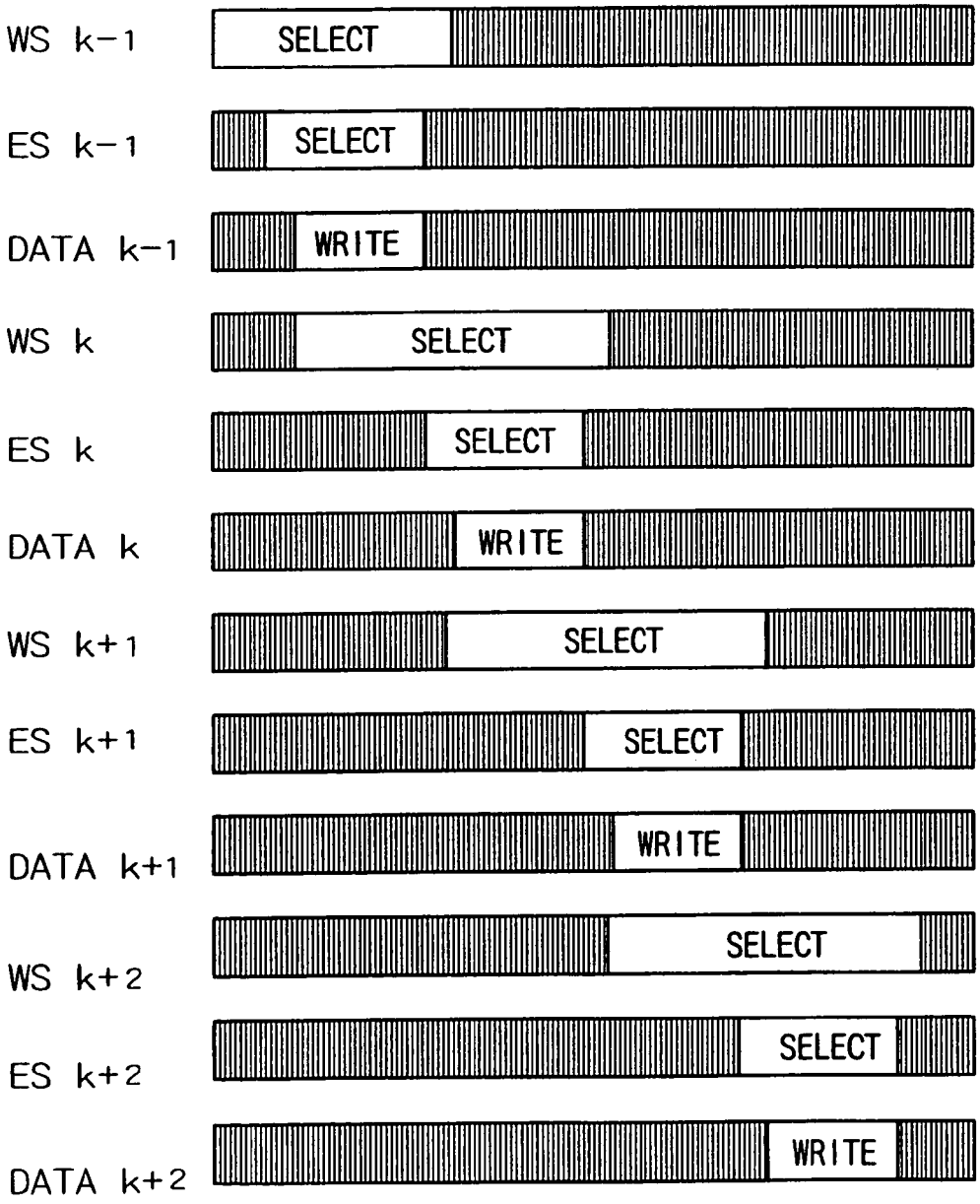
FIG. 11 is a timing chart (1) of a driving timing relation in the ith column in the second embodiment.
Figure 12:
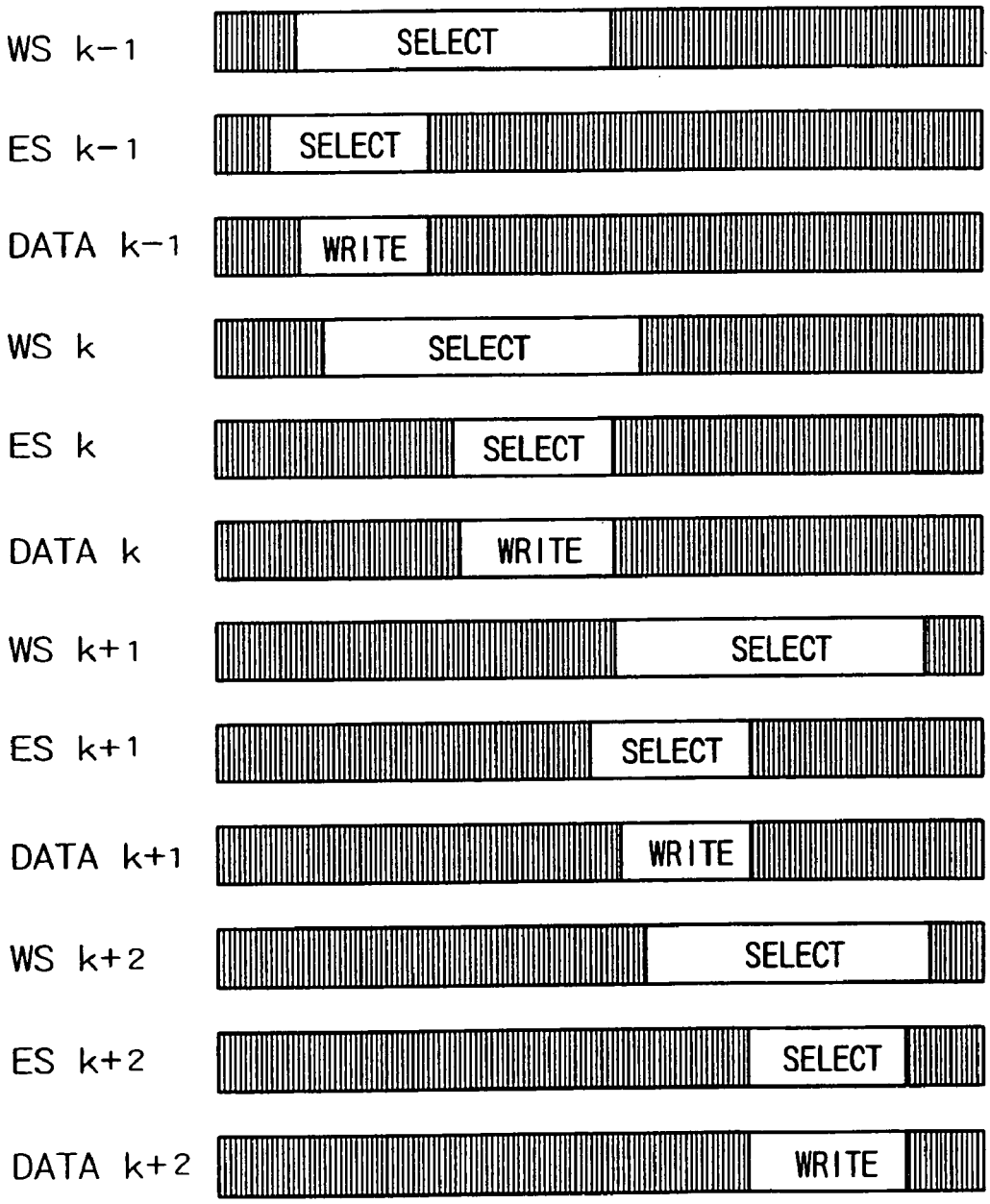
FIG. 12 is a timing chart (2) of a driving timing relation in the ith column in the second embodiment.

A circuit configuration of a plurality of pixel circuits 11-k−1 to 11-k+2 connected to an ith-column data line 14-*i* in the active matrix type display apparatus according to the second embodiment is shown in FIG. 10. Each of the pixel circuits 11-k−1 to 11-k+2 has a configuration of the current writing type pixel circuit having four transistors (TFTs), which is the same as the pixel circuit according to the first embodiment. FIG. 11 and FIG. 12 show driving timing relations between the plurality of pixel circuits 11-k−1 to 11-k+2.

In both examples of FIG. 11 and FIG. 12, x (x=2 in the examples) pixel circuits continuous in a column direction are selected simultaneously. When the two pixel circuits are thus selected simultaneously, part of a data line current for driving the data line is written as a luminance data current to one of the pixel circuits. In this case, although the luminance data current is not written to part of the other of the pixel circuits, the pixel circuit is used as a bypass current circuit (data current control circuit) to which the remainder of the data line current is fed.

In the example of FIG. 12, in particular, when x (x=2 in the example) pixel circuits continuous in the column direction are grouped as one block and a data current is written to one of the pixel circuits in the block, the data current is not written to the other pixel circuits in the same block, but the other pixel circuits are used as bypass current circuits. In this case, a first scanning line WS and a second scanning line ES of the pixel circuit to which the data current is written are both selected. Supposing that the pixel circuit 11-k−1 in FIG. 10 is the pixel circuit to which the data current is written, for example, WSk−1 and ESk−1 are both selected.

On the other hand, in the pixel circuit to which the data current is not written but which is used as the bypass current circuit, only the first scanning line WS is selected. In the example of FIG. 10, a first scanning line WSk is selected and a second scanning line ESk is not selected. Thus, TFTs 24 and 25 function as a data current control circuit (bypass current circuit) used for bypass current.

Specifically, since the second scanning line ESk of the pixel circuit shown in FIG. 10 is not selected and thus a TFT 26 is in an off state, a charge corresponding to luminance data and retained by a capacitor 23 is not discharged through the TFT 26, but remains retained. In this case, only part of the circuit, or the TFTs 24 and 25 function as the data current control circuit (bypass current circuit).

Gate width of the TFT 24 is W11; gate length of the TFT 24 is L11; gate width of the TFT 25 is W12; gate length of the TFT 25 is L12; and the data current flowing through the TFTs 24 and 25 is Iw1. In this case, the following relational equation holds between the data current Iw1 and data line current Iw0:

$$Iw0=x\cdot Iw1$$

Thus, $$1:x=Iw1:Iw0$$

The following relational equation holds between the gate width W11 and gate length L11 of the TFT 24, the gate width W12 and gate length L12 of the TFT 25, the gate width W01 and gate length L01 of the TFT 124, and the gate width W02 and gate length L02 of the TFT 125 in the pixel circuit according to the conventional example (see FIG. 3):

$$\begin{aligned} Iw0 &= x\cdot Iw1 \\ &= (W11/L11):(W01/L01) \\ &= (W12/L12):(W02/L02) \end{aligned}$$

For example, supposing that the gate length does not change, as described above, then $$W11=1/x\cdot W01$$

$$L11=L01$$

$$W12=1/x\cdot W02$$

$$L12=L02$$

Thus, assuming that the data current having the same current value as the bypass current is written to the pixel circuit 11-*k*, the gate widths Will and W12 of the TFTs 24 and 25 in the pixel circuit 11-*k* can be reduced to 1/x of the gate widths W01 and W02 of the TFTs 124 and 125 in the conventional circuit. In other words, when the size of the transistors in the pixel circuit is set to be the same as in the conventional circuit, the data line current Iw0 can be substantially increased.

As described above, in the active matrix type organic EL display apparatus using the current writing type pixel circuits 11, two pixel circuits adjacent to each other in the column direction are selected simultaneously, and part of the data line current Iw0 is supplied to the pixel circuit for writing luminance data and the remaining current is fed as a bypass current to part of the other pixel circuit. It is thereby possible to set the data line current Iw0 greater than the data current Iw1 flowing through the TFTs 24 and 25 in the pixel circuit 11 while preventing an increase in the size of the TFTs 24 and 25. It is thereby possible to reduce the data writing time substantially and thus increase the size and resolution of the organic EL display apparatus.

It is to be noted that while in writing the data current, the second embodiment simultaneously selects two (x=2) pixel circuits adjacent to each other in the column direction, the present invention is not limited to two pixel circuits, and more pixel circuits can be selected simultaneously. By increasing the number of pixel circuits to be selected and thus increasing the number of pixel circuits used as a data current path, it is possible to further reduce the size of the transistors in the pixel circuit, or further increase the current value of the data line current Iw0. However, from a trade-off relation, since a distance between the transistors forming the current mirror circuit is increased, effect of compensation for variations in transistor characteristics is correspondingly reduced.

Moreover, while in the second embodiment, the pixel circuit to which luminance data is not written but which is selected as a pixel circuit used as a bypass current circuit is a pixel circuit adjacent in the column direction to the pixel circuit for writing the luminance data, the pixel circuit is not necessarily limited to the adjacent one.

Furthermore, even when two pixel circuits adjacent to each other in the column direction are selected simultaneously as in the second embodiment, characteristics of the transistors forming the current mirror circuit may be varied and thus present a problem. It is generally known that in a case where thin film transistors are used as the transistors in the pixel circuits, when N-type transistor characteristics become stronger, P-type transistor characteristics become weaker, or when P-type transistor characteristics become stronger, N-type transistor characteristics become weaker; thus variations in characteristics of a P-channel and an N-channel transistor are in an opposite direction from each other.

Hence, by using field-effect transistors of opposite conduction types as the TFT 24 for a scanning switch and the TFT 25 for current-to-voltage conversion, for example an N-channel field-effect transistor as the TFT 24 and a P-channel field-effect transistor as the TFT 25 in the pixel circuit shown in FIG. 10, variations in characteristics of the transistors cancel each other out, whereby variation in potential of the data line can be controlled. For the above reason, it is desirable to use field-effect transistors of opposite conduction types as the TFTs 24 and 25.

While the second embodiment has been described above by taking as an example an active matrix type display apparatus provided with current writing type pixel circuits of a four-transistor configuration, the current writing type pixel circuits are not limited to pixel circuits of the four-transistor configuration. Pixel circuits of other than the four-transistor configuration will be described in the following.

Figure 13:
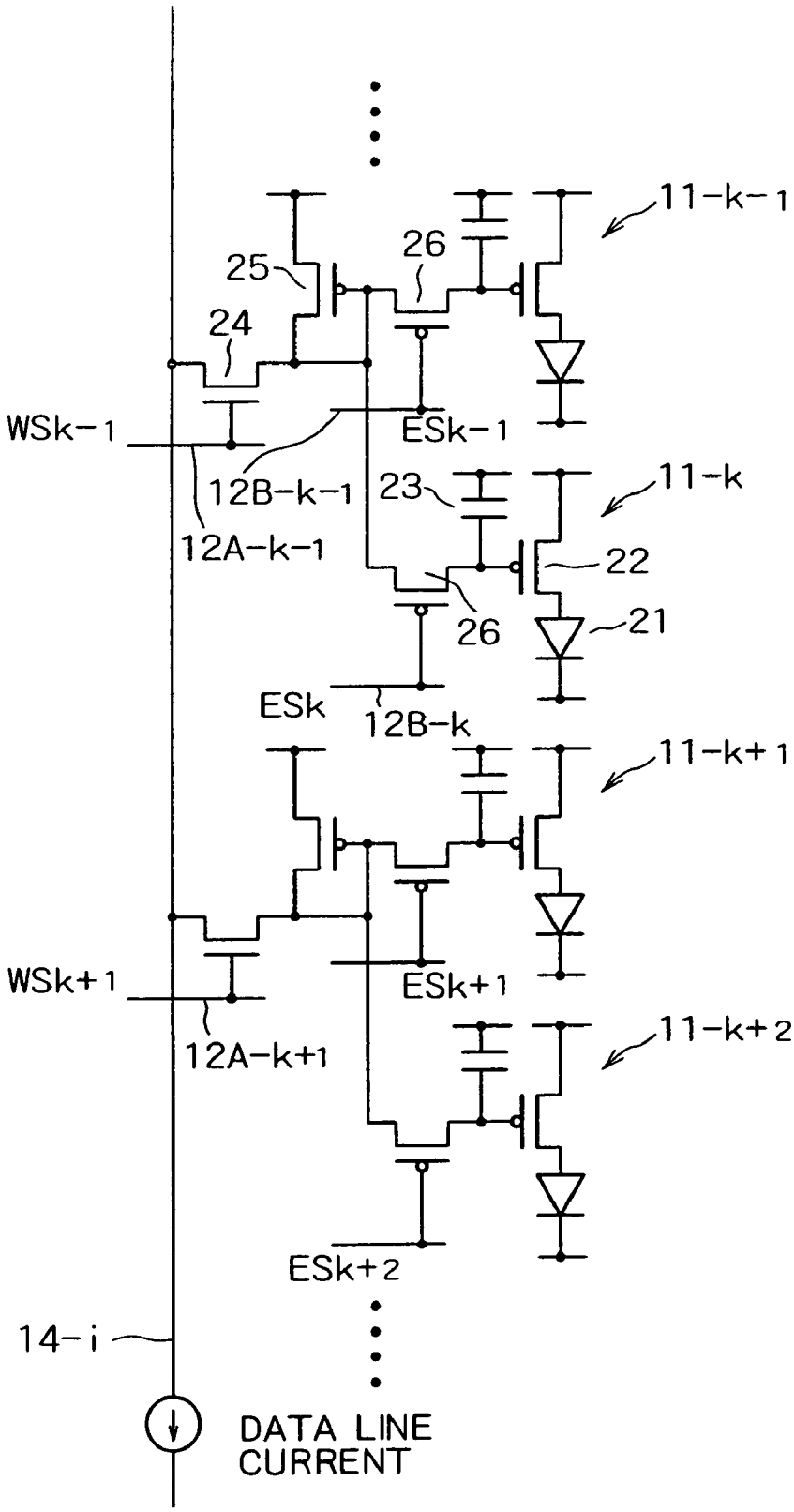
FIG. 13 is a circuit diagram showing an example of configuration other than a four-transistor configuration of pixel circuits.

FIG. 13 is a circuit diagram showing an example of configuration other than the four-transistor configuration of current writing type pixel circuits. The pixel circuits according to the present example are configured such that a scanning TFT 24 and a current-to-voltage conversion TFT 25 are shared between two pixels adjacent to each other, for example, in each column. Specifically, as for a first scanning line 12A, scanning lines 12Ak−1, 12Ak+1, . . . are arranged one for every two pixels. In the case of a k−1 and a k pixel, for example, a gate of the scanning TFT 24 is connected to the scanning line 12Ak−1, and a source of the scanning TFT 24 is connected with a drain and gate of the current-to-voltage conversion TFT 25 and drains of TFTs 26 and 26 of the two pixels.

Figure 14:
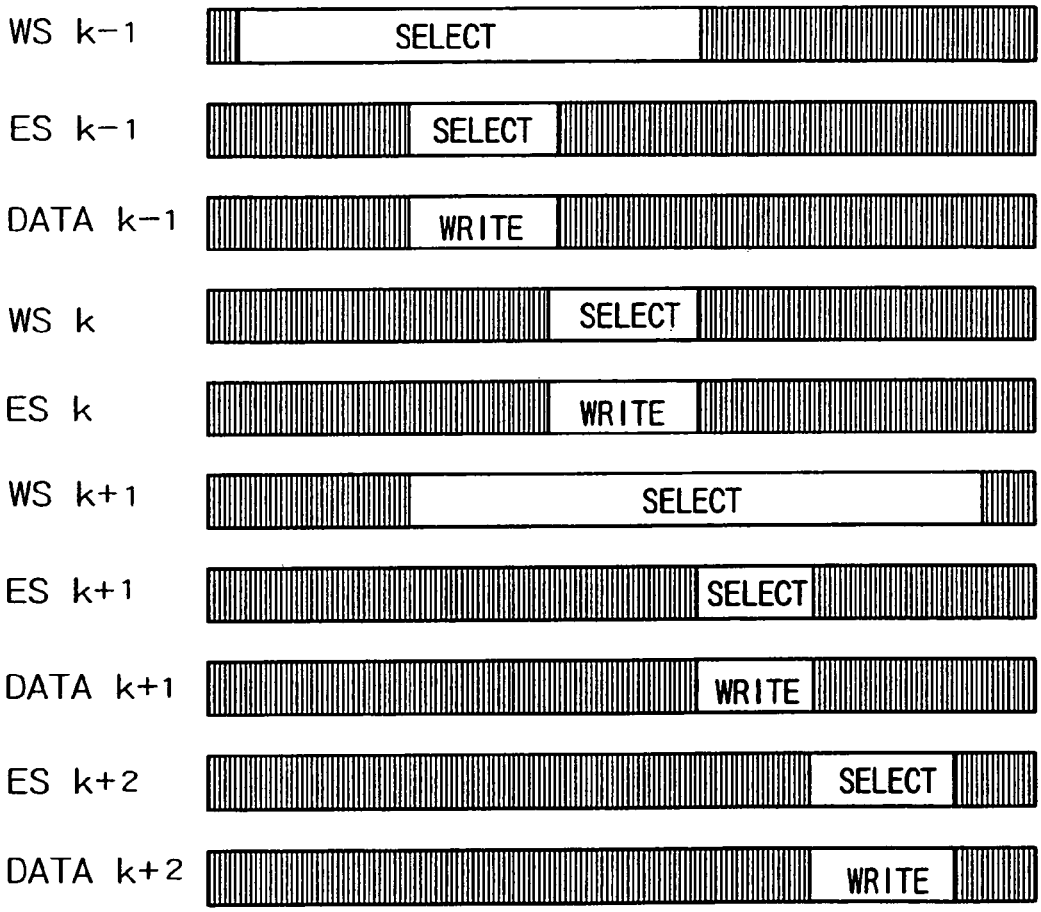
FIG. 14 is a timing chart of a driving timing relation when a scanning TFT and a current-to-voltage conversion TFT are shared between two pixels.

FIG. 14 shows a driving timing relation when the pixel configuration in which the scanning TFT 24 and the current-to-voltage conversion TFT 25 are shared between two pixels is used. Fundamental operation in this case is the same as in the foregoing example. In this case, the current-to-voltage conversion TFT 25 can be shared between two pixels because the TFT 25 is used only at a moment of writing a data current.

By using such a pixel configuration in which the scanning TFT 24 and the current-to-voltage conversion TFT 25 are shared between two pixels adjacent to each other, for example, it is possible to omit two transistors in every two pixels. The number of transistors in two pixels is six, and therefore the number of transistors per pixel is three.

A current flowing through a data line 14-*i* is much greater than a current flowing through an organic EL device 21. Therefore, large transistors are used as the scanning TFT 24 and the current-to-voltage conversion TFT 25 that directly deal with the great current, thus inevitably resulting in a large area being occupied by the transistors.

On the other hand, by using the pixel configuration in which the scanning TFT 24 and the current-to-voltage conversion TFT 25 are shared between two pixels as in the pixel circuits according to the present example, it is possible to greatly reduce the area of the pixel circuits occupied by the TFTs and thus it is possible to extend a stacking arrangement of light emitting units or reduce pixel size to thereby increase resolution.

While the present example is a circuit example in which the scanning TFT 24 and the current-to-voltage conversion TFT 25 are shared between two pixels, it is obvious that the scanning TFT 24 and the current-to-voltage conversion TFT 25 can be shared between three pixels or more. In this case, effect of reducing the number of transistors is further increased. In addition, instead of sharing both the scanning TFT 24 and the current-to-voltage conversion TFT 25, it is possible to share only one of the TFTs between a plurality of pixels.

Third Embodiment

Figure 15:
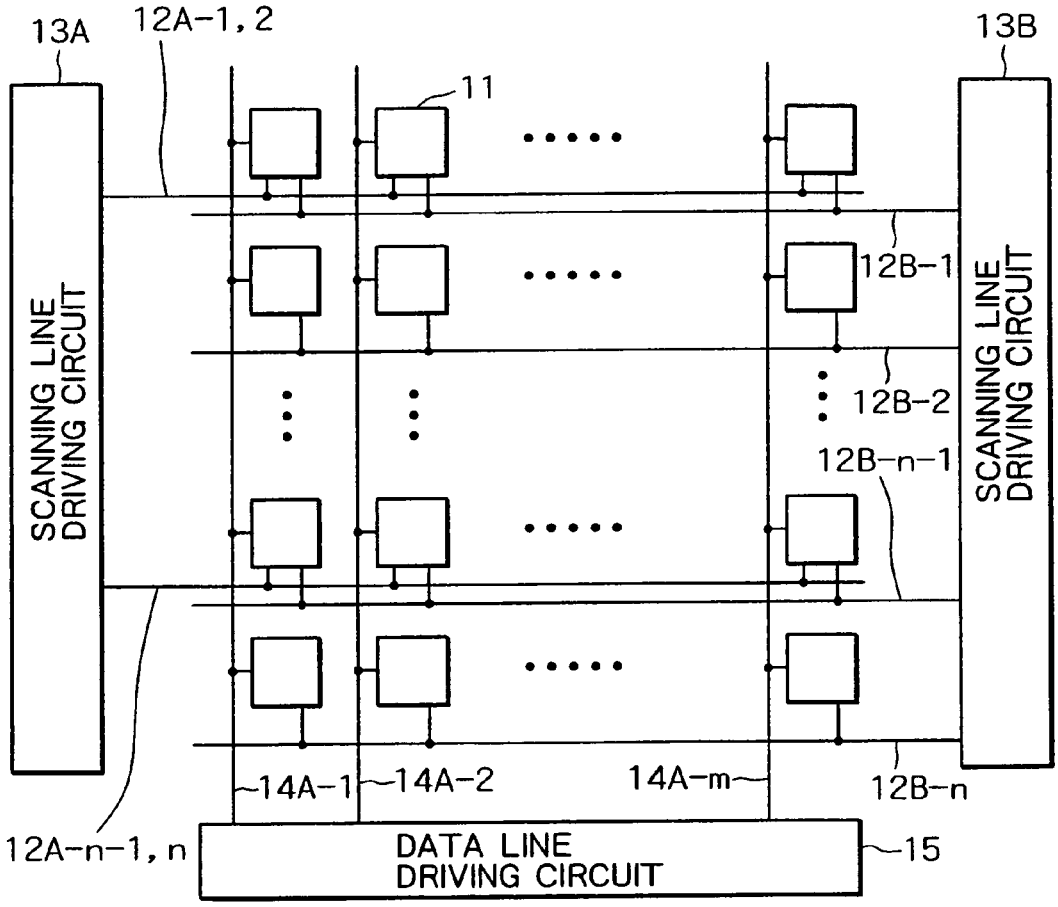
FIG. 15 is a schematic diagram of a configuration of an active matrix type display apparatus according to a third embodiment of the present invention.

FIG. 15 is a schematic diagram of a configuration of an active matrix type display apparatus according to a third embodiment of the present invention.

As with the active matrix type display apparatus according to the second embodiment, the active matrix type display apparatus according to the third embodiment is configured so as to share a first scanning line WS between x pixel circuits in the same block when x pixel circuits continuous in the column direction are formed into one block and selected simultaneously, and a data current is written to one of the pixel circuits and the other pixel circuits are used as bypass current circuits.

As described above regarding the active matrix type display apparatus according to the second embodiment, when two pixel circuits in the same block are selected simultaneously, scanning lines WS of the driven circuits operate in the same manner, and therefore the scanning line WS can be shared in the same block. In the present example, where x=2, a scanning line 12A-1, 12A-2 is shared between a first-row and a second-row pixel circuit, . . . , and a scanning line 12A-n−1, 12A-n is shared between an (n−1)th-row and an nth-row pixel circuit.

Figure 16:
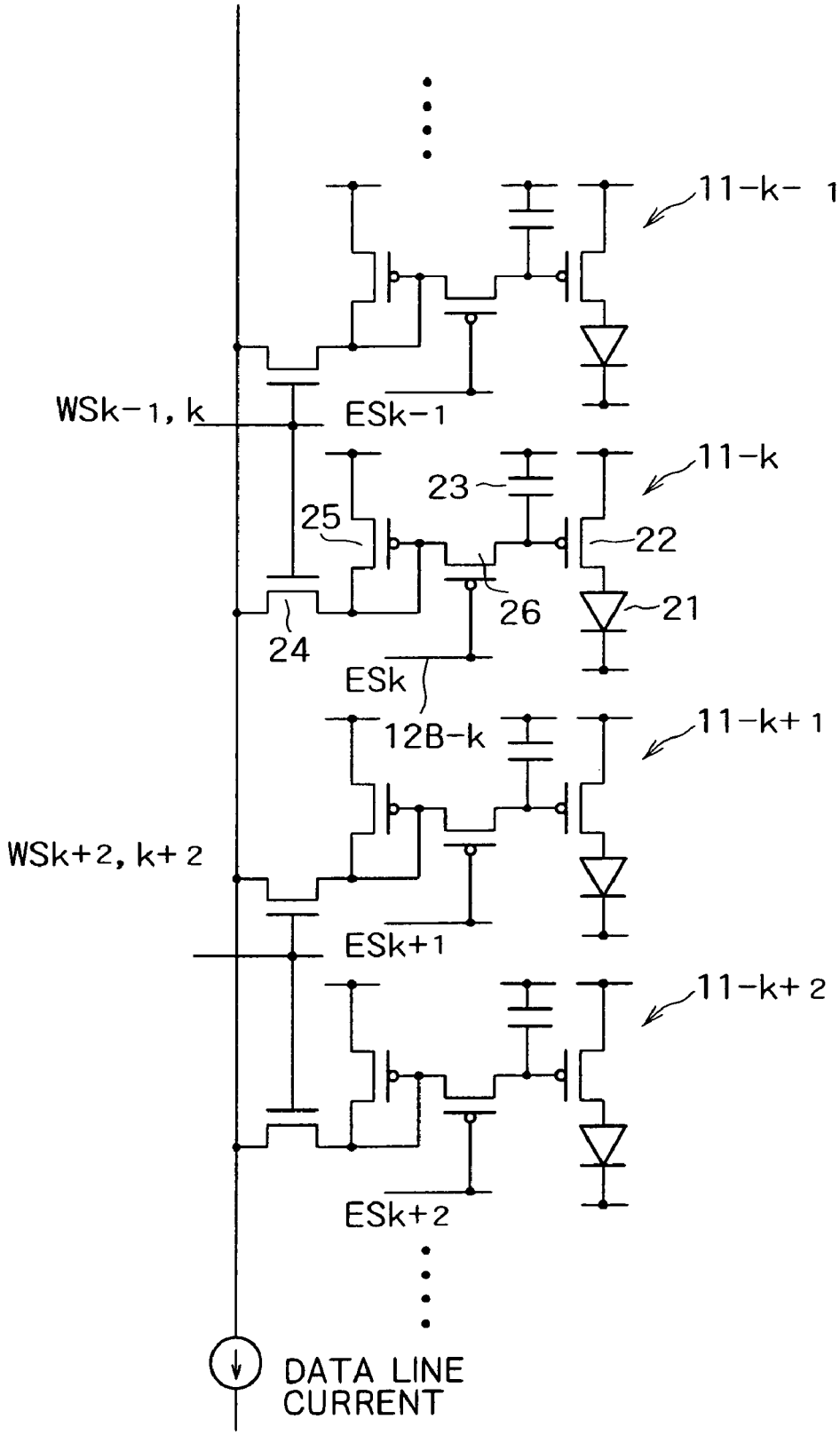
FIG. 16 shows a circuit configuration of a plurality of pixel circuits connected to an ith-column data line in the third embodiment.
Figure 17:
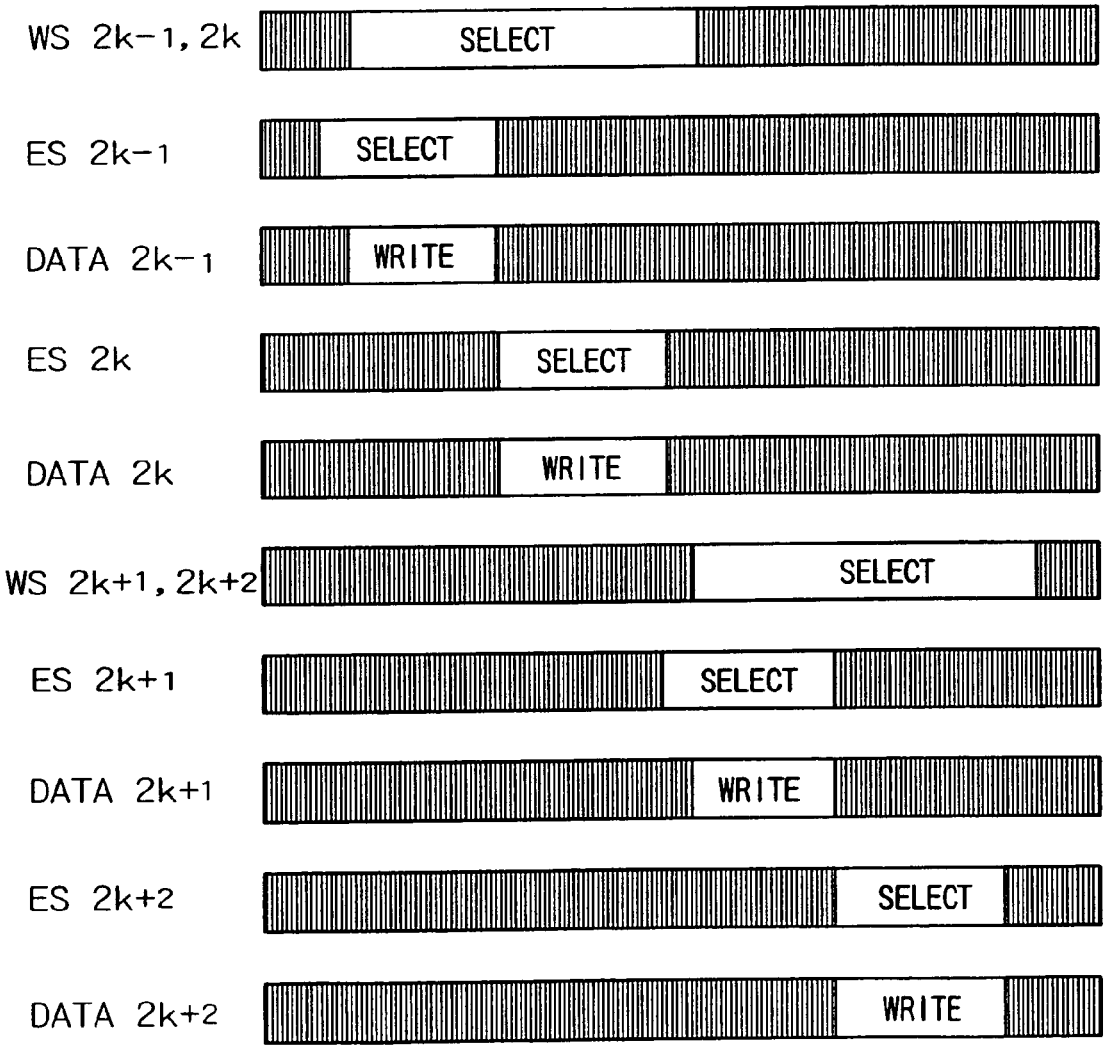
FIG. 17 is a timing chart of a driving timing relation in the ith column in the third embodiment.

A circuit configuration of a plurality of pixel circuits 11-k−1 to 11-k+2 connected to an ith-column data line 14-*i* in the active matrix type display apparatus according to the third embodiment is shown in FIG. 16. Each of the pixel circuits 11-k−1 to 11-k+2 has the same configuration as the pixel circuit according to the first embodiment, that is, the configuration of the current writing type pixel circuit having four transistors (TFTs). FIG. 17 shows driving timing of the plurality of pixel circuits 11-k−1 to 11-k+2.

As described above, in the active matrix type organic EL display apparatus in which x pixel circuits continuous in the column direction are formed into one block and selected simultaneously, and in which part of a data line current is written as a data current to the pixel circuit for writing luminance data and the other pixel circuits are used as bypass current circuits, the first scanning line WS is shared between the x pixel circuits in the same block. It is thereby possible to reduce the number of first scanning lines WS to 1/x. Thus, in addition to the effects obtained by the second embodiment, it is possible to reduce display size in the column direction (vertical direction) by an amount corresponding to the reduction in the number of scanning lines WS.

While in the third embodiment, the x pixel circuits continuous in the column direction are formed into one block, the pixel circuits do not necessarily need to be continuous in the column direction; discrete x pixel circuits may be formed into a block. Also in this case, although wire routing is required in each of the pixel circuits, the first scanning line WS can be shared between the x pixel circuits in the same block.

Fourth Embodiment

An active matrix type display apparatus according to a fourth embodiment of the present invention will next be described. A configuration of the active matrix type display apparatus according to the fourth embodiment is substantially the same as that of the active matrix type display apparatus according to the third embodiment as shown in FIG. 15.

Figure 18:
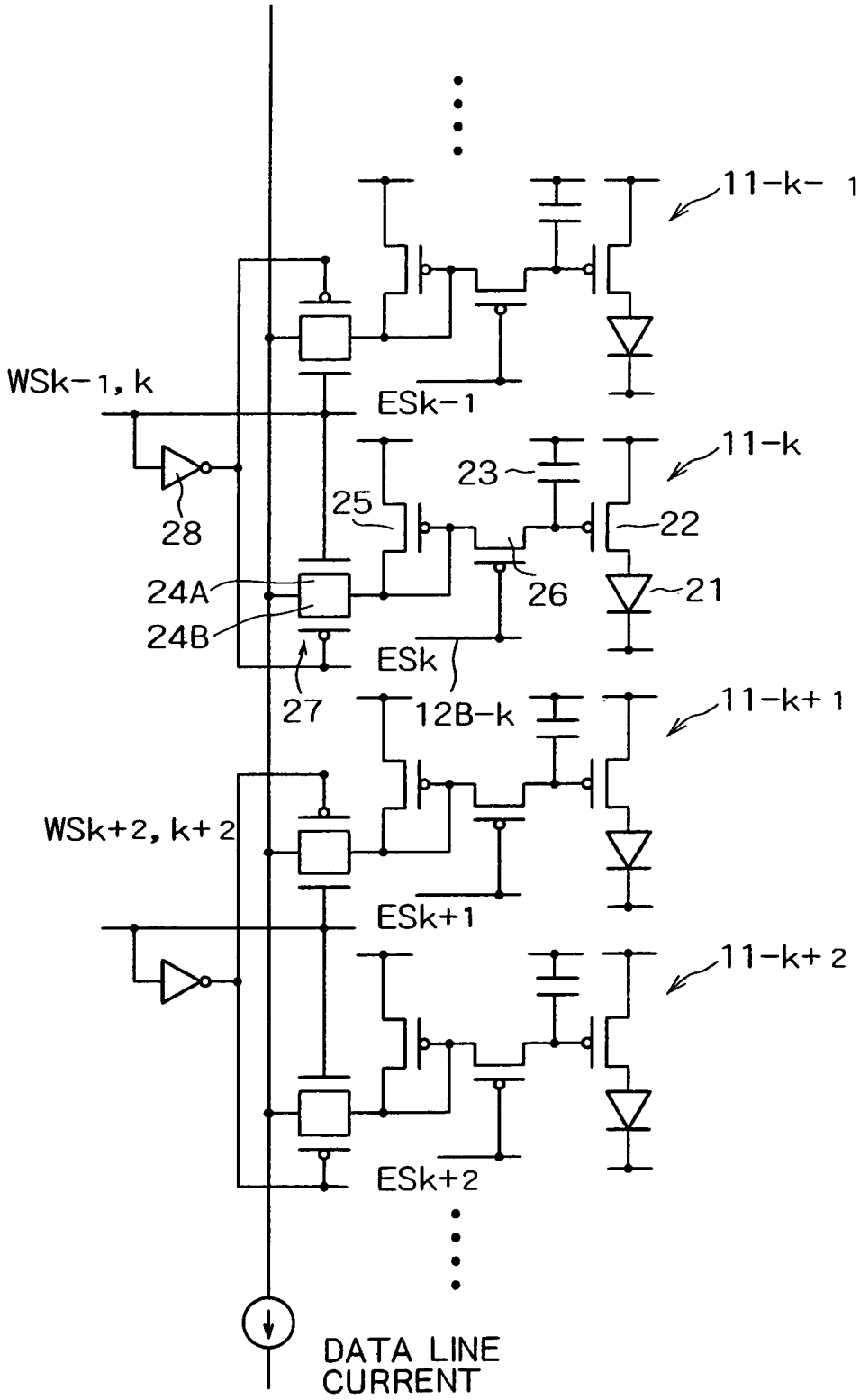
FIG. 18 shows a circuit configuration of a plurality of pixel circuits connected to an ith-column data line in a fourth embodiment.

A circuit configuration of a plurality of pixel circuits 11-k−1 to 11-k+2 connected to an ith-column data line 14-*i* in the active matrix type display apparatus according to the fourth embodiment is shown in FIG. 18. The pixel circuits 11-k−1 to 11-k+2 according to the present example use, as an analog switch, a CMOS transistor 27 formed by connecting an N-channel TFT 24A and a P-channel TFT 24B in parallel with each other in place of the N-channel TFT 24 in the pixel circuit shown in FIG. 16. Potential of a first scanning line WSk−1, k is supplied directly to a gate of the N-channel TFT 24A, and is inverted by an inverter 28 and then supplied to a gate of the P-channel TFT 24B.

Usually, a pixel circuit uses a unipolar switch as an analog switch because of a limitation in area or the like. On the other hand, as described as effects of the second embodiment, for example, by simultaneously selecting two pixels adjacent to each other in the column direction, and writing a data current to one of the pixels and not writing the data current to the other pixel circuit but using the other pixel circuit as a bypass current circuit, it is possible to set a writing data current greater than the current flowing through the transistors of the pixel while preventing an increase in the size of the transistors. In other words, when the current value of the writing data current is set unchanged, it is possible to reduce the transistor area of the pixel. Thus, the CMOS transistor 27 can be used as an analog switch of the pixel.

When a low current is passed through the TFTs 24 and 25 in the pixel circuit according to the third embodiment, a source potential of the TFT 24 is increased and a gate-to-source potential of the TFT 24 is decreased, so that the TFT 24 may not be fully turned on. On the other hand, in the pixel circuit according to the fourth embodiment, an analog switch is formed by using the CMOS transistor 27. Therefore, when a low current is passed through the CMOS transistor 27 and a TFT 25, the TFT 24B is fully turned on even if the TFT 24A is not fully turned on, so that the CMOS transistor 27 can be fully turned on.

It is to be noted that the foregoing embodiments have been described by taking as an example a case where an organic EL device is used as a display device of a pixel, and a polysilicon thin film transistor is used as an active device of the pixel so that the present invention is applied to active matrix type organic EL display apparatus obtained by forming the organic EL device on a substrate where the polysilicon thin film transistor is formed; however, the present invention is not limited to the application to the active matrix type organic EL display apparatus, and the present invention is applicable to active matrix type display apparatus in general that use, as a display device of a pixel, a so-called current-controlled type electrooptic device that changes brightness thereof according to a current flowing therein.

As described above, the active matrix type display apparatus or active matrix type organic EL display apparatus according to the present invention supply part of a data line current for driving a data line as a bypass current. It is thereby possible to set the data line driving current greater than a data current flowing through TFTs provided in a pixel circuit, and thus substantially reduce luminance data writing time. In addition, when the writing time is set unchanged, transistor size of the TFTs provided in the pixel circuit can be reduced. It is thus possible to increase the size and resolution of the display.

While the preferred embodiments of the present invention have been described using the specific terms, such description is for illustrative purposes only, and it is to be understood that changes and variations may be made without departing from the spirit or scope of the following claims.

What is claimed is:

1. An active matrix type display apparatus, comprising:

a pixel unit formed by arranging a plurality of pixel circuits in a plurality of rows and a plurality of columns, said pixel circuits each having an electrooptic device;

a plurality of data lines, each data line being operatively connected to a respective one of the rows or columns of said pixel circuits;

data line driving means operatively connected each of the data lines for supplying luminance data to said pixel circuits via a plurality of data line currents, each of said data line currents being supplied to a respective one of said data lines; and current control means for dividing each data line current supplied from said data line driving means into a respective data current for writing the luminance data to each of said pixel circuits and a respective remaining bypass current.

2. An active matrix type display apparatus as claimed in claim 1, wherein said current control means includes a plurality of data current control circuits, each data current control circuit is operatively connected to a respective one of the data lines such that each current control circuit is provided in a block formed by the row or column of pixel circuits connected to the same respective one of the data lines.

3. An active matrix type display apparatus as claimed in claim 1, wherein said bypass current of said data line current is equal to or greater than said data current.

4. An active matrix type display apparatus, comprising:

an electrooptic device;

a pixel unit formed by arranging pixel circuits in a matrix manner, said pixel circuits each writing luminance data to said electrooptic device by a respective data current supplied through a data line; and current control means for effecting control such that part of a data line current for driving said data line is supplied as the data current to a pixel circuit for writing the luminance data and a remaining bypass current from the same data line current is passed through a part of another pixel circuit connected to the same data line.

5. An active matrix type display apparatus as claimed in claim 4, wherein said bypass current of said data line current is equal to or greater than said data current.

6. A driving method of an active matrix type display apparatus, said active matrix type display apparatus including: an electrooptic device; and a plurality of current writing type pixel circuits arranged in a matrix manner, said pixel circuits each writing luminance data to said electrooptic device by a respective data current supplied through a data line, said driving method comprising:

dividing a data line current for driving said data line into the respective data current for writing the luminance data to each of said pixel circuits and a remaining bypass current, and thus supplying the data line current.

7. A driving method of an active matrix type display apparatus, said active matrix type display apparatus including: an electrooptic device; and a plurality of current writing type pixel circuits arranged in a matrix manner, said pixel circuits each writing luminance data to said electrooptic device by a respective data current supplied through a data line, said driving method comprising:

supplying part of a data line current for driving said data line as the respective data current to one of the pixel circuits for writing the luminance data and passing a remaining part of the data line current as a bypass current through a part of another pixel circuit connected to the same data line.

8. An active matrix type organic electroluminescence display apparatus, comprising:

a pixel unit formed by arranging a plurality of current writing type pixel circuits in a matrix manner, said pixel circuits each having an organic electroluminescence device with a first electrode, a second electrode, and an organic layer including a light emitting layer between the first electrode and the second electrode, and said pixel circuits each writing luminance data by a respective data current supplied through a data line;

data line driving means for supplying luminance data to said pixel circuits as a data line current via said data lines; and current control means for dividing the data line current supplied from said data line driving means into the respective data current for writing the luminance data to each of said pixel circuits and a remaining bypass current, and thus driving the data line current.

9. An active matrix type organic electroluminescence display apparatus as claimed in claim 8, wherein said current control means is provided in a block formed by a portion of said pixel circuits connected to the same data line of said pixel unit.

10. An active matrix type organic electroluminescence display apparatus as claimed in claim 8, wherein said bypass current of said data line current is equal to or greater than said data current.

11. An active matrix type organic electroluminescence display apparatus, comprising:

a pixel unit formed by arranging a plurality of current writing type pixel circuits in a matrix manner, said pixel circuits each having an organic electroluminescence device with a first electrode, a second electrode, and an organic layer including a light emitting layer between the first electrode and the second electrode, and said pixel circuits each writing luminance data by a respective data current supplied through a data line; and current control means for effecting control such that part of a data line current for driving said data line is supplied as the data current to one of the pixel circuits for writing the luminance data and a remaining bypass current from the same data line current is passed through a part of another pixel circuit connected to the same data line.

12. An active matrix type organic electroluminescence display apparatus as claimed in claim 11, further comprising a driving means for driving the luminance data to said pixel circuits as a data line current via said data line, wherein the data current supplied from said current control means to said pixel circuit is greater than the data line current driven by said driving means.

13. A driving method of an active matrix type organic electroluminescence display apparatus, said active matrix type organic electroluminescence display apparatus including a plurality of current writing type pixel circuits arranged in a matrix manner, said pixel circuits each having an organic electroluminescence device with a first electrode, a second electrode, and an organic layer including a light emitting layer between the first electrode and the second electrode, and said pixel circuits each writing luminance data by a respective data current supplied through a data line, said driving method comprising:

dividing a data line current for driving said data line into the data current for writing the luminance data to each of said pixel circuits and a remaining bypass current, and thus supplying the data line current.

14. A driving method of an active matrix type organic electroluminescence display apparatus, said active matrix type organic electroluminescence display apparatus including a plurality of current writing type pixel circuits arranged in a matrix manner, said pixel circuits each having an organic electroluminescence device with a first electrode, a second electrode, and an organic layer including a light emitting layer between the first electrode and the second electrode, and said pixel circuits each writing luminance data by a respective data current supplied through a data line, said driving method comprising:

supplying part of a data line current for driving said data line as the data current to a pixel circuit for writing the luminance data and passing a remaining part of the data line current as a bypass current through a part of another pixel circuit connected to the same data line.

* * * * *